US005322013A

United States Patent [19]

Haupenthal

[11] Patent Number: 5,322,013

[45] Date of Patent: Jun. 21, 1994

[54] DEVICE FOR REMOTELY CONTROLLING CLAMPING DEVICES ON CYLINDERS IN A ROTARY PRINTING PRESS

[75] Inventor: Rudi Haupenthal, Epfenbach, Fed. Rep. of Germany

[73] Assignee: Heidelberger Druckmaschinen AG, Heidelberg, Fed. Rep. of Germany

[21] Appl. No.: 871,172

[22] Filed: Apr. 20, 1992

[30] Foreign Application Priority Data

Aug. 18, 1991 [DE] Fed. Rep. of Germany ..... 4112666

[51] Int. Cl.[5] ..... B41F 21/00

[52] U.S. Cl. ..... 101/415.1; 101/378; 101/409

[58] Field of Search ..... 101/378, 383, 409, 410, 101/411, 412, 415.1

[56] References Cited

U.S. PATENT DOCUMENTS

| | | | |
|---|---|---|---|
| 3,058,417 | 10/1962 | Norlin | 101/415.1 |
| 3,456,588 | 7/1969 | Brodie | 101/415.1 |
| 3,715,981 | 1/1973 | Huffman | 101/415.1 |
| 4,646,639 | 3/1987 | Gollinger et al. | 101/415.1 |
| 4,848,230 | 7/1989 | Haupenthal | 101/409 |
| 5,076,166 | 12/1991 | Herold et al. | 101/415.1 |
| 5,094,165 | 3/1992 | Sugiyama et al. | 101/415.1 |
| 5,142,305 | 8/1992 | Maslanka et al. | 101/415.1 X |

FOREIGN PATENT DOCUMENTS

| | | | |
|---|---|---|---|
| 1939358 | 6/1970 | Fed. Rep. of Germany . | |
| 2341326 | 3/1975 | Fed. Rep. of Germany . | |
| 3443353 | 6/1986 | Fed. Rep. of Germany . | |
| 3604071 | 8/1987 | Fed. Rep. of Germany | 101/415.1 |
| 0140254 | 8/1983 | Japan | 101/415.1 |

*Primary Examiner*—Edgar S. Burr
*Assistant Examiner*—Christopher A. Bennett
*Attorney, Agent, or Firm*—Herbert L. Lerner; Laurence A. Greenberg

[57] ABSTRACT

A device for actuating a clamping device on at least one paper-guiding cylinder in a rotary printing press, including a positioning unit having a device for applying a pressure medium thereto, a lever mechanism cooperatively engageable with the positioning unit, a device for remotely controlling a clamping device on a respective paper-guiding cylinder through the intermediary of the lever mechanism, the clamping device having a clamping bar and a device for actuating the clamping bar into a clamping mode and into a nonclamping mode, the actuating device being cooperatively engageable with the positioning unit, and spring devices for maintaining the clamping bar in the clamping mode wherein a cylinder covering is clamped thereby on the respective cylinder.

6 Claims, 7 Drawing Sheets

Figure 3A:
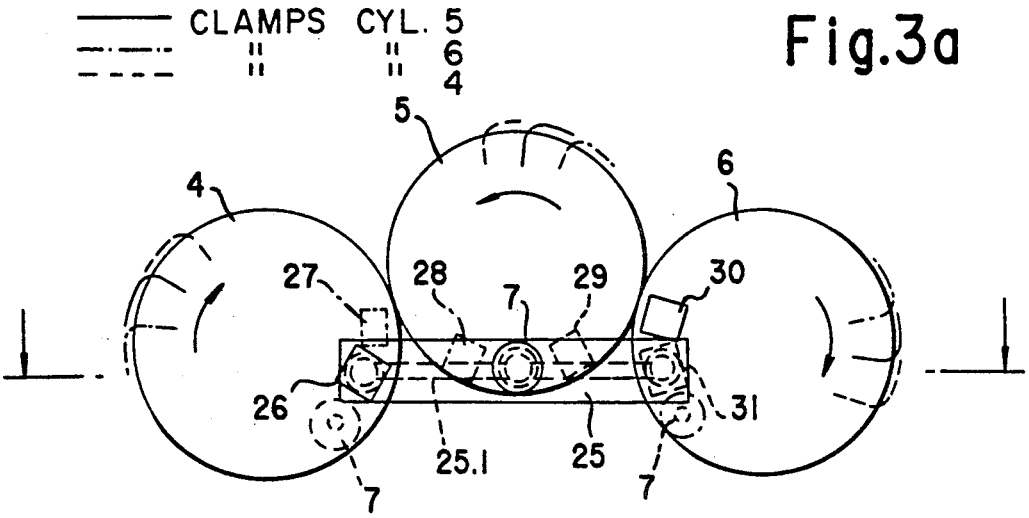

Fig.1a
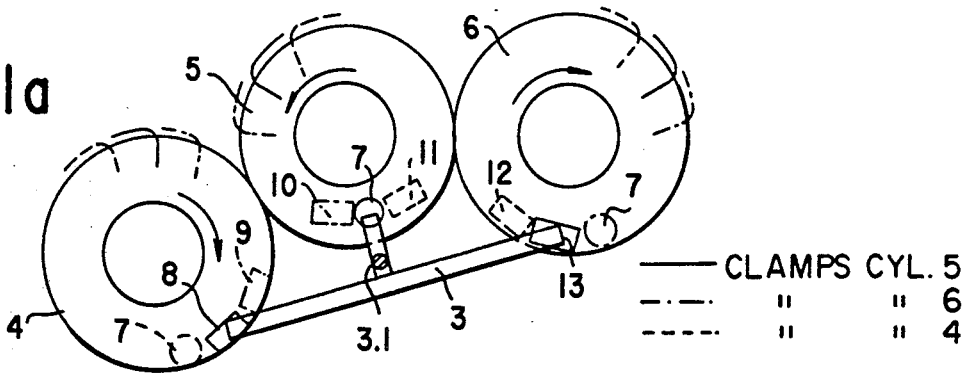
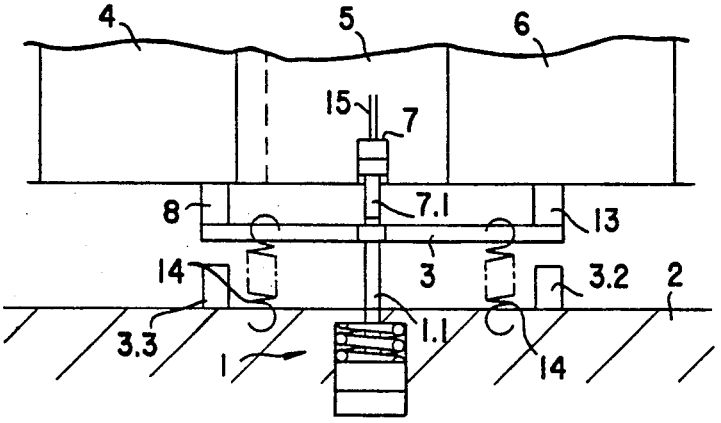
Fig.1b
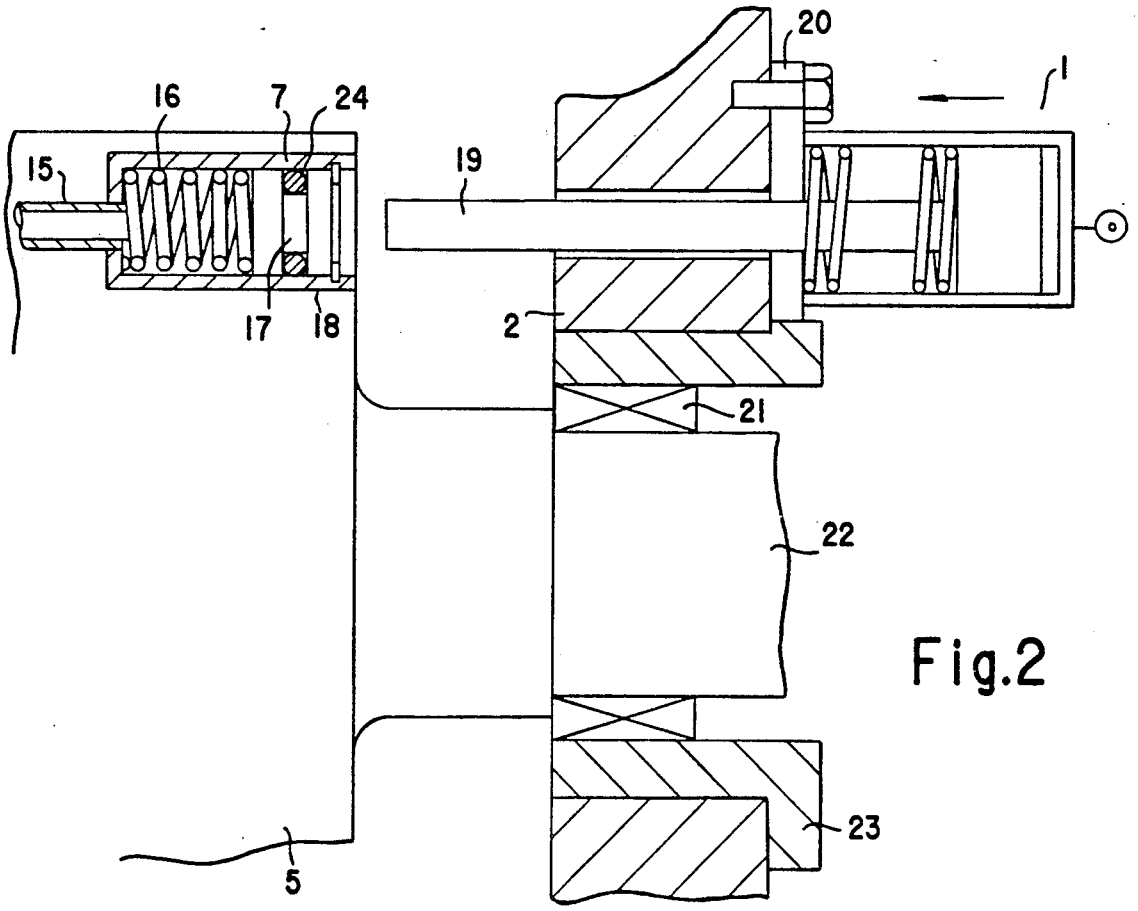
Fig.2

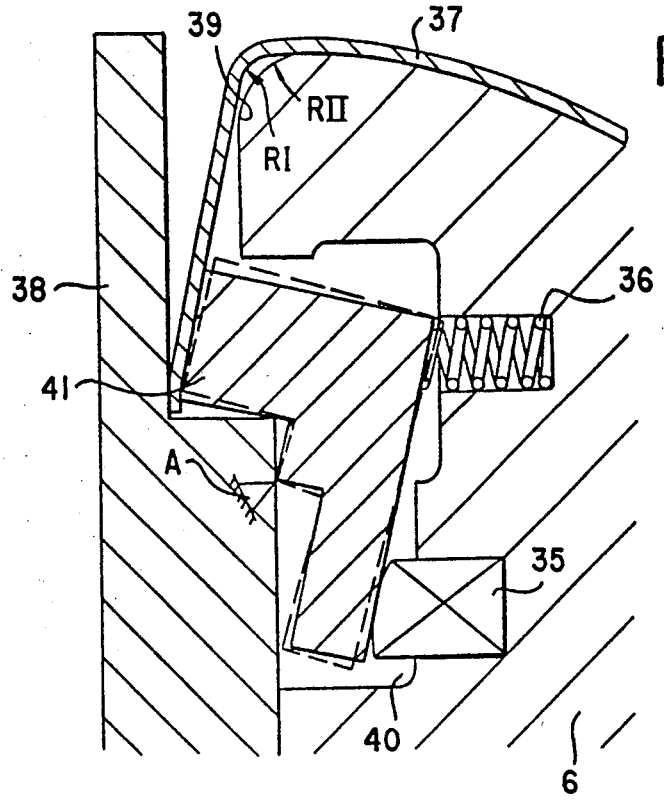
Fig.4a
Fig.4b
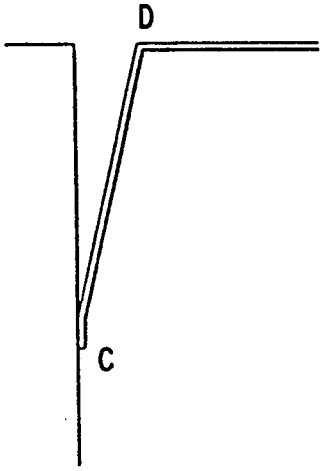
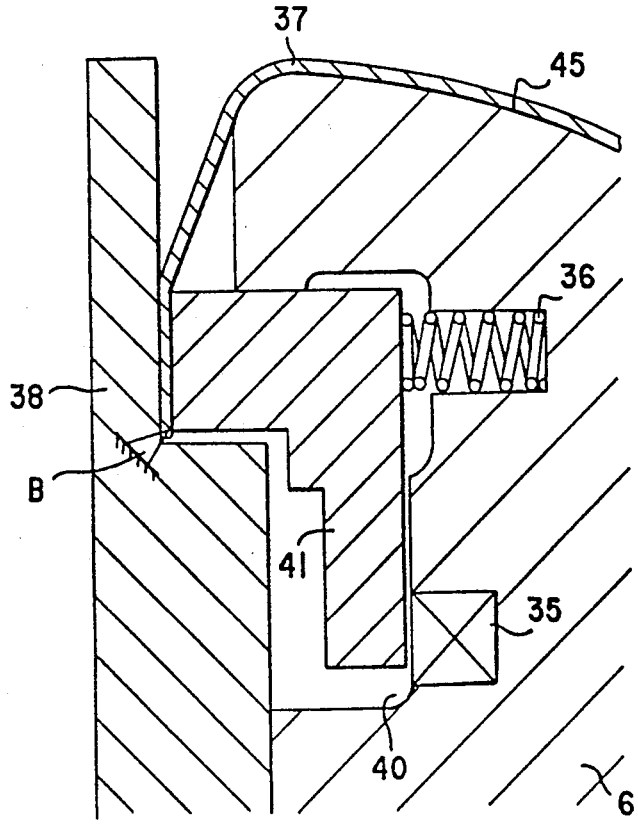
Fig.4c
Fig.4d
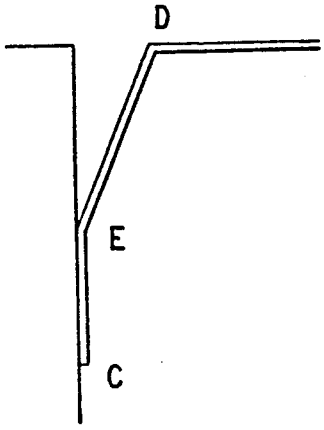

DEVICE FOR REMOTELY CONTROLLING CLAMPING DEVICES ON CYLINDERS IN A ROTARY PRINTING PRESS

The invention relates to a device for remotely controlling clamping devices on cylinders in rotary printing presses, An attachment device for cylinder coverings on impression cylinders has become known heretofore from German Published Non-Prosecuted Application (DE-OS) 23 41 326 wherein an angle iron is fixed, through the intermediary of a bolt against the action of a spring, to the base of a cylinder gap provided in the impression cylinder. As the bolt is screwed down, the angle iron, which is supported on one leg, tightens a cylinder covering with the other leg.

A disadvantage of this device, however, is that the bolts for clamping the angle iron are accessible only with great difficulty below the gripper shaft. For correctly clamping the angle iron, it is necessary to tighten a great number of bolts over the length of the cylinder in order to be able to keep the clamping force more-or-less constant over the length of the cylinder. Through the tightening of the bolts, the magnitude of the clamping force is at the subjective discretion of the pressman, which presents a potential source of error. If the cylinder coverings are not correctly clamped, fatigue fractures may occur in impression cylinders at the bend of the cylinder-gap edge due to the constant roll-over which occurs as the cylinder rotates.

It is accordingly an object of the invention to provide a device for remotely controlling clamping devices on cylinders in a rotary printing press which avoids the foregoing disadvantages of heretofore known devices of this general type.

It is a more specific object of the invention to provide such a device which affords remote control clamping with great operational reliability and relatively simple service requirements, and which ensures that the cylinder coverings rest correctly on the outer cylindrical surfaces of the cylinder when clamped.

With the foregoing and other objects in view, there is provided, in accordance with the invention, a device for actuating a clamping device on at least one paper-guiding cylinder in a rotary printing press, comprising a positioning unit having means for applying a pressure medium thereto, a lever mechanism cooperatively engageable with the positioning unit, means for remotely controlling a clamping device on a respective paper-guiding cylinder through the intermediary of the lever mechanism, the clamping device having a clamping bar and means for actuating the clamping bar into a clamping mode and into a nonclamping mode, the actuating means being cooperatively engageable with the positioning unit, and spring means for maintaining the clamping bar in the clamping mode wherein a cylinder covering is clamped thereby on the respective cylinder.

Various advantages of this construction are, initially, that it is possible to integrate the clamping device for cylinder coverings on paper-guiding cylinders into the central remote-control system of the printing press. Furthermore, the cylinder coverings can be clamped uninfluenced by the subjective direction of the pressman, thereby virtually eliminating incorrect clamping. Moreover, clamping is rendered considerably faster and the setting-up or make-ready times shorter. In addition, remotely controllable clamping permits the application of a more uniform clamping force over the length of the cylinder. The maintenance of the clamping force by mechanical forces ensures high operational reliability if there is a pressure drop in the pressure system.

In accordance with another feature of the invention, the clamping-bar actuating means comprise a positioning cylinder installed in the paper-guiding cylinder.

In accordance with a further feature of the invention, there are provided a plurality of paper-guiding cylinders, respectively, having a positioning cylinder and supports installed therein, the lever mechanism being remotely controllable for actuating the respective positioning cylinder of one of the plurality of paper-guiding cylinders while simultaneously cooperatively engaging the supports, respectively, of the others of the plurality of paper-guiding cylinders. When the positioning cylinder in one of the paper-guiding cylinders is actuated by the lever mechanism, this lever mechanism thus cooperates with supports of the remaining cylinders of the paper-conducting cylinders.

In accordance with an alternate feature of the invention, there are provided a plurality of paper-guiding cylinders respectively having a positioning cylinder and closures installed therein, the lever mechanism having means for actuating a positioning member of one of the plurality of paper-guiding cylinders while the lever mechanism is braced against the closures of the others of the plurality of paper-guiding cylinders, the lever-mechanism actuating means comprising pressure medium applicable through the intermediary of a connector mutually connecting the lever mechanism and the positioning cylinder.

With the aid of this construction, it is possible to actuate a clamping device on each of the paper-guiding cylinders. A positioning unit acts upon a positioning cylinder, which is installed in a space-saving manner in the paper-guiding cylinder. As further noted hereinafter, one positioning unit can be used to actuate the respective clamping device on all of the paper-guiding cylinders in a printing unit of the printing press.

In accordance with a further feature of the invention, there is provided an expansible hollow body, and a pressure-medium line connecting the expansible hollow body to the positioning cylinder.

In accordance with an additional feature of the invention, the expansible hollow body extends over the entire length of the cylinder. The expansible hollow body ensures a uniform movement of the clamping bar, so that the cylinder coverings are not subjected to uneven mechanical loading or stressing. This extends the service life of the cylinder coverings.

In accordance with an added feature of the invention, the paper-guiding cylinder has an outer cylindrical surface and a leading edge formed therein, and the clamping-bar actuating means include means for relieving pressure in the hollow body from the pressure medium in the pressure-medium line, whereby the clamping bar is actuated to move the cylinder covering in a radial direction and around the leading edge and onto the outer cylindrical surface. The cylinder covering is consequently subjected to tension and is adjusted to the curvature of the outer cylindrical surface of the respective paper-guiding cylinder. When cylinder coverings are used on impression cylinders in the printing unit, the constant roll over and the consequent high mechanical loading or stressing do not therefore negatively affect the service life of the cylinder coverings.

In accordance with an alternative feature of the invention, the clamping bar actuating means include means for initially and subsequently relieving pressure in the hollow body so that initially, the clamping bar is turnable by the spring means about a first turning axis and, subsequently, the clamping bar is swivellable by the spring means about a second turning axis. Consequently, in a first step, the cylinder covering is held at its front or leading end between the gripper-support bar and the clamping bar and, in a second step, by providing further pressure relief of the hollow body, the cylinder covering is held taut.

In accordance with yet another feature of the invention, there is provided an expansible hollow body disposed in the paper-guiding cylinder adjacent the clamping bar for moving the clamping bar against the spring means.

In accordance with yet a further feature of the invention, there are provided a gripper-support bar carried by the respective paper-guiding cylinder, a pressure body fixable to the gripper-support bar and housing a piston sealed by O-rings, and a pressure medium line connecting the pressure body to the positioning cylinder for actuating the piston against the spring means to move the clamping bar.

This offers the possibility also of disposing the parts subjected to pressure medium at locations outside of the paper-guiding cylinders. Furthermore, with such a support arrangement, the gripper-support bar is not subjected to any force which might tend to deform it, leading thereby to an improvement in the quality of printing.

In accordance with yet an additional feature of the invention, there are provided a plurality of paper-guiding cylinders in a respective printing unit of the printing press, the positioning unit having means for applying the pressure medium to all of the plurality of paper-guiding cylinders for remotely controlling the clamping devices thereon.

In accordance with a concomitant feature of the invention, there are provided a tensioning lever cooperatively connected with the clamping bar, expansible hollow bodies respectively engageable with at least one of the tensioning lever and the clamping bar, respective pressure-medium lines connected to the expansible hollow bodies, and an operator-control element connectible to the pressure-medium lines for selectively pressurizing the expansible hollow bodies with pressure medium via the pressure-medium lines so as to move the tensioning lever and the clamping bar against the spring means, whereby the tensioning and clamping of a cylinder covering on the respective paper-guiding cylinder is released by remote control. It is advantageous to include the clamping and tensioning operations on the paper-guiding cylinders at both the front and rear or leading and trailing edges of the cylinder covering. Errors by the pressman are prevented, because the sequence of clamping and tensioning operations is prescribed. Precisely defined clamping forces permit long service lives of the cylinder coverings. Clamping is accomplished by spring force, so that high operational reliability while clamping the cylinder covering is maintained.

Other features which are considered as characteristic for the invention are set forth in the appended claims.

Although the invention is illustrated and described herein as embodied in a device for remotely controlling clamping devices on cylinders in a rotary printing press, it is nevertheless not intended to be limited to the details shown, since various modifications and structural changes may be made therein without departing from the spirit of the invention and within the scope and range of equivalents of the claims.

Figure 3B:
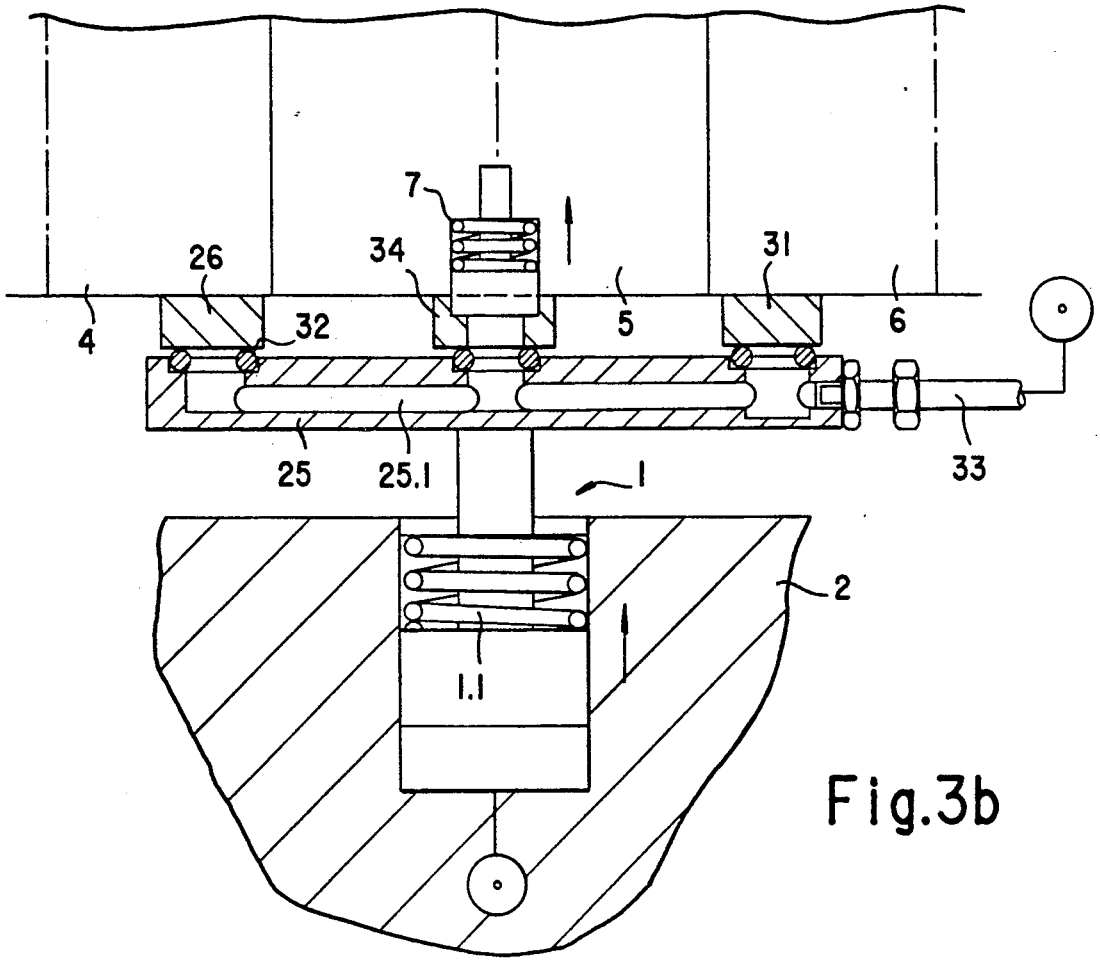
Figure 5A:
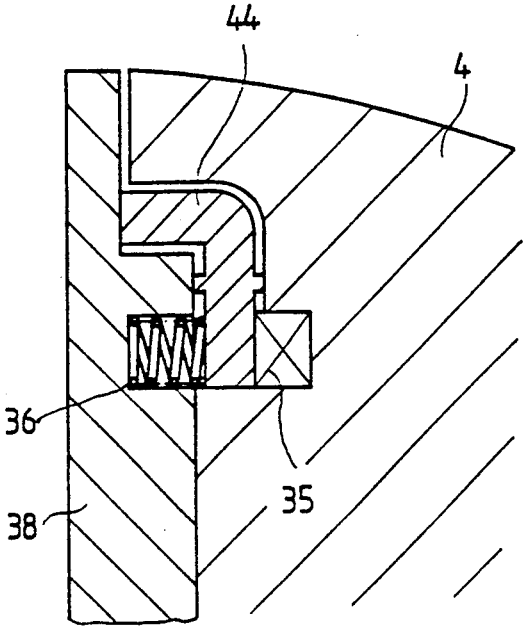
Figure 5B:
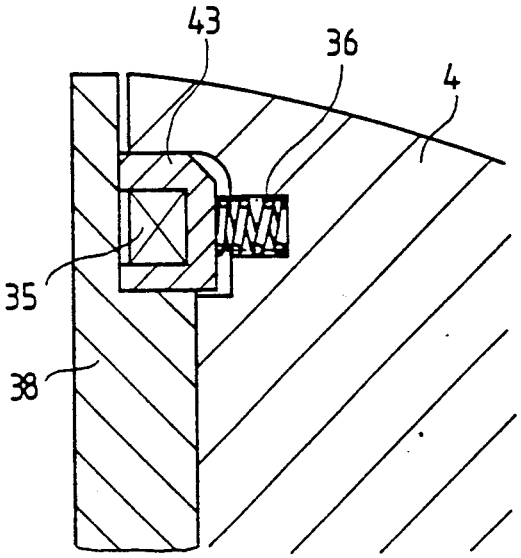
Figure 5C:
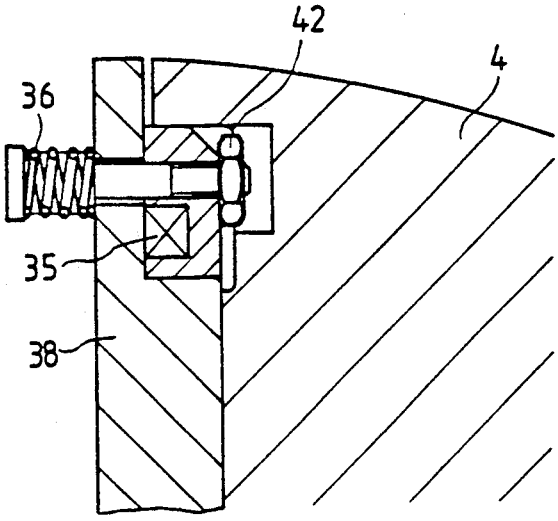
Figure 6A:
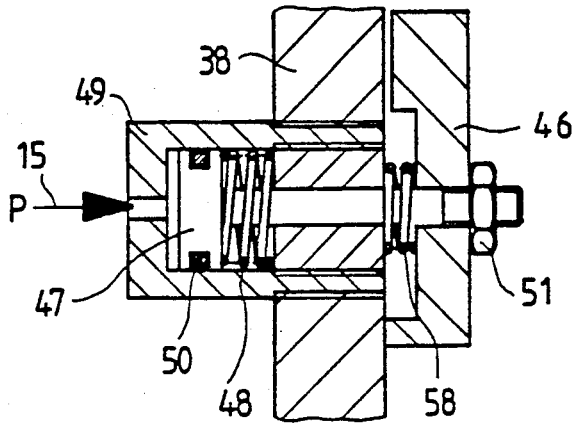
Figure 6B:
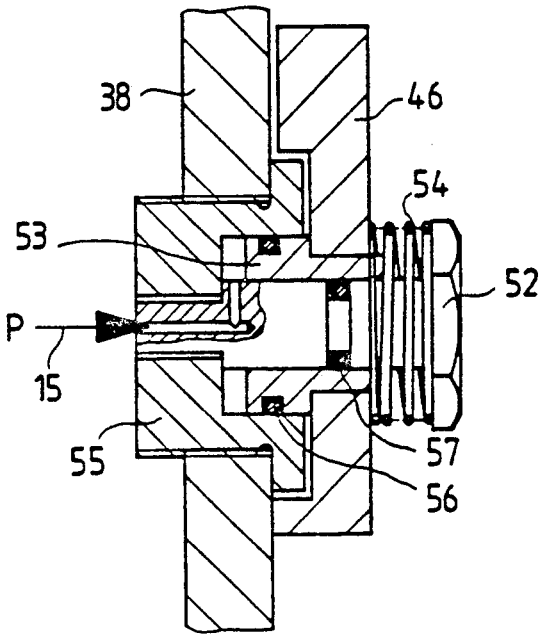
Figure 7:
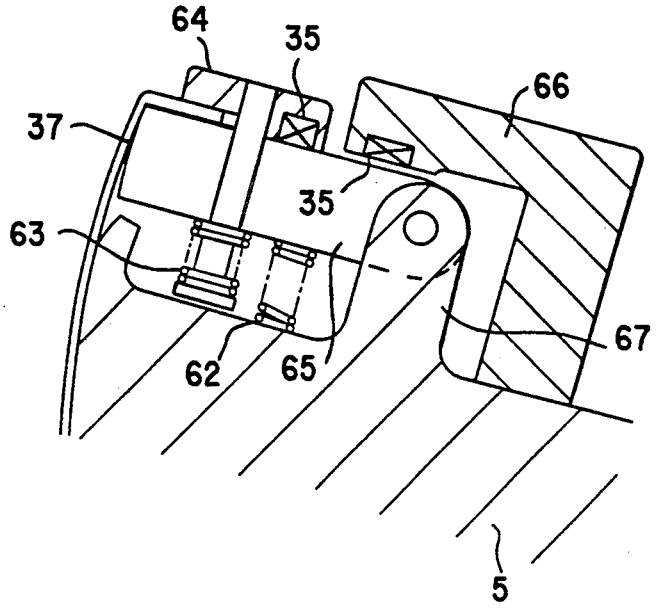
Figure 7A:
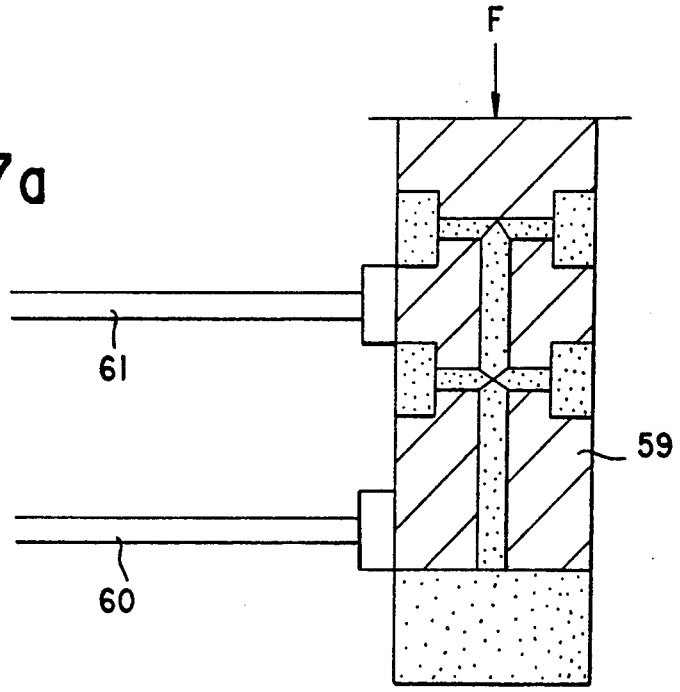
Figure 7B:
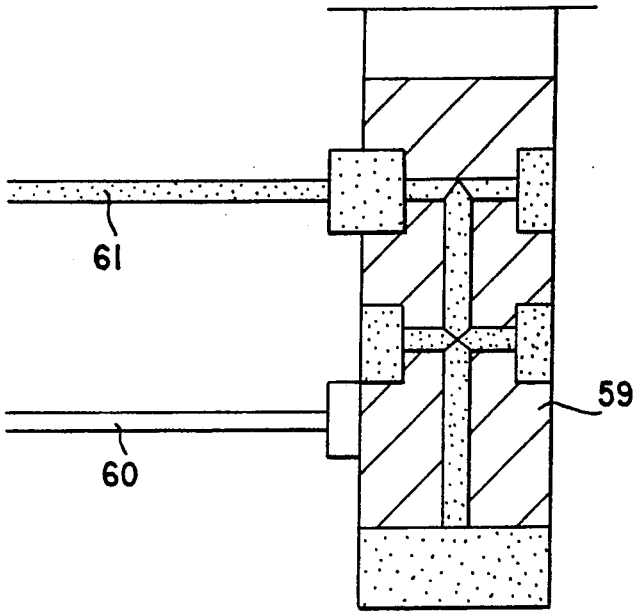
Figure 7C:
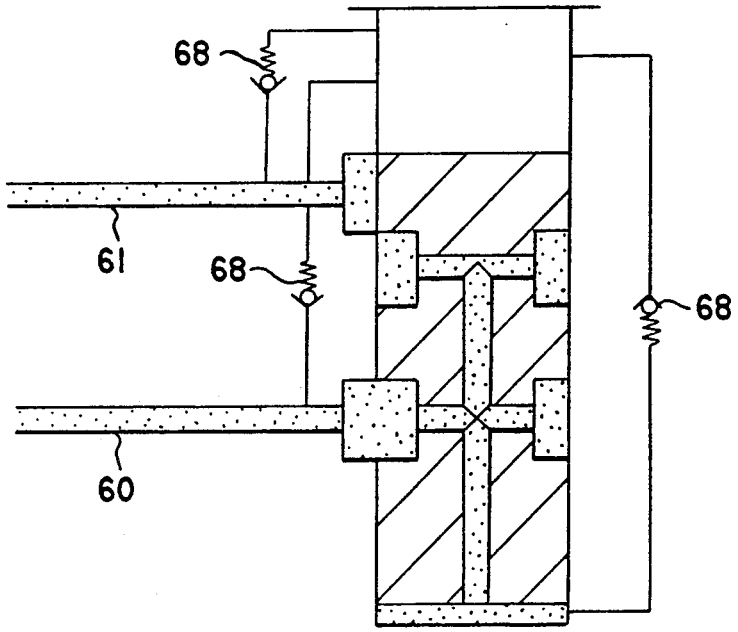

The construction and method of operation of the invention, however, together with additional objects and advantages thereof will be best understood from the following description of specific embodiments when read in connection with the accompanying drawings, in which:

FIGS. 1*a* and 1*b* are diagrammatic end and top plan views, respectively, of an actuating mechanism for clamping devices on three paper-guiding cylinders;

FIG. 2 is a diagrammatic side elevational view, partly in section of a remotely controllable actuating mechanism mounted in a side wall;

FIGS. 3*a* and 3*b* are views, somewhat enlarged, like those of Figs. 1*a* and 1*b*, respectively, of a remote-control mechanism for clamping devices modified with a compressed-air connection;

FIGS. 4*a* and 4*b* are fragmentary cross-sectional views of a clamping device of FIG. 3*a* showing a clamping bar during a clamping operation, triggered by a deformable seal in two phases of the operation;

FIGS. 4*a'* and 4*b'* are schematic views of FIGS. 4*a* and 4*b*, respectively;

FIGS. 5*a*, 5*b* and 5*c* are views similar to that of FIG. 4*b*, of different embodiments of the invention which include deformable seals energized by pressure medium;

FIGS. 6*a* and 6*b* are cross-sectional views of different embodiments of hydraulic cylinders for installation in a gripper support bar;

FIG. 7 is a fragmentary cross-sectional view of FIG. 1, for example, showing a clamping device at a trailing edge of one of the cylinders; and FIGS. 7*a*, 7*b* and 7*c* are fragmentary diagrammatic and schematic views of a device for applying pressure to an operator control element of the clamping device of FIG. 7. Referring now to the drawings and, first, particularly to FIGS. 1*a* and 1*b* thereof, there is shown therein an actuating mechanism for clamping devices of three paper-guiding cylinders. In a side wall 2 of a rotary printing press, a positioning unit is installed, which serves to move a lever mechanism 3. The lever mechanism 3 is mounted via the intermediary of a ball joint 3.1 on a piston rod 1.1 of the positioning unit 1. Mounted opposite the positioning unit 1 and the lever mechanism 3 are three paper-guiding cylinders 4, 5 and 6. Each of the paper-guiding cylinders 4, 5 and 6 carries a positioning cylinder 7. In addition to the positioning cylinder 7, the paper-guiding cylinder 4 is provided with a support 8 as well as a support 9. The paper-guiding cylinder 5 has two supports 10 and 11; and the paper-guiding cylinder 6 has two supports 12 and 13. Additionally shown in FIG. 1*b* is a pressure-medium line 15 which is connected to the positioning cylinder 7 for supplying energy to the clamping device which is to be actuated.

The legend in FIG. 1*b* applies to FIG. 1*a* and explains the symbols which mark the adjusted position of the individual paper-guiding cylinders 4, 5 and 6. The unbroken, broken and phantom lines identify the position of the starting end of a cylinder covering as shown in FIG. 4*a*, for example. In the set position shown in FIG. 1*a*, the clamping of the paper-guiding cylinder 5 is actuated by the lever mechanism 3. The lever mechanism 3 is thrust outwardly against the force of return or restoring springs 14 by the positioning unit 1 and moves a piston 7.1 which is disposed in the positioning cylinder 7. In the rest or neutral position of the lever mechanism 3, the latter is held by the biasing action of the springs 14 against stops 3.2 and 3.3 which are fixed to the side wall 2. A gap or spacing is thereby provided between the rotating paper-guiding cylinders 4, 5 and 6 and the lever mechanism 3. When a cylinder covering is clamped onto the paper-guiding cylinder 5, the positioning unit 1 is subjected to pressure. Due to the outward extension of the piston rod 1.1 on the positioning unit 1, the lever mechanism 3 is moved towards the paper-guiding cylinders 4, 5 and 6 until the lever mechanism 3 rests upon the supports 8 and 13 and the piston 7.1 of the positioning cylinder 7. In a further stroke of the positioning unit 1, the supports 8 and 13 engage two ends, respectively, of the lever mechanism 3, while a free third end of the lever mechanism 3 actuates the piston 7.1 of the positioning cylinder 7.

The different travel paths of the various lever ends resulting from the location of the positioning cylinders 7 in the paper-guiding cylinders 4, 5 and 6 with respect to the ends of the lever mechanism 3, are compensated for by different diameters of the pistons 7.1 in the positioning cylinders 7. The volume required for actuating the clamping device can be set by suitably dimensioning the positioning travel path. The maximum required pressure is determined by the force applied to the piston 7.1 by the positioning cylinder 7.

In the embodiment illustrated in FIGS. 1*a* and 1*b*, the positioning unit 1 is formed as a pneumatic cylinder. Alternatively, however, constructions with an hydraulic cylinder, diaphragms or threaded spindles are applicable.

Positioning of the paper-guiding cylinders 4, 5 and 6 can be accomplished both by an inching service or mode of operation conventionally provided in a printing press, wherein the cylinders are turned only a few degrees of arc, as well as by automatic movement to the cylinder position, which is achieved by selecting the cylinders to be actuated and the appropriate printing unit from the central operator-control panel.

After the clamping of the paper-guiding cylinder 5, for example, has been actuated by the lever mechanism 3, the latter is disengaged from the supports 8 and 13 as well as from the piston 7.1 in the positioning cylinder 7 and, by "inching", the paper-guiding cylinders 4, 5 and 6 are turned in the direction of the arrows. The lever mechanism 3 is then brought into engagement with the paper-guiding cylinders 4, 5 and 6. The lever mechanism 3 then rests on supports 9 and 10 (shown in phantom) of the paper-guiding cylinders 4 and 5 and has actuated the piston 7.1 in the positioning cylinder 7 on the paper-guiding cylinder 6.

After a subsequent clamping of a cylinder covering to the cylinder 6, the lever mechanism 3 is again placed against the stops, the cylinders are moved in the opposite direction and clamping is performed at the paper-guiding cylinder 4. The lever mechanism 3 is braced against the supports 11 and 12, shown in broken lines, of the paper-guiding cylinders 5 and 6, respectively.

FIG. 2 is a detailed view of a remotely controlled actuating mechanism which is mounted in a side wall. A piston 17 provided with an O-ring 24 is displaceably mounted in the positioning cylinder 7 of a paper-guiding cylinder 5. The positioning travel pass of the piston 17 extending in a direction towards the end face of the cylinder 5 is limited by a retaining ring 18. The piston 17 is displaced by an extensible piston rod 19 towards and against a compression spring 16 disposed in the positioning cylinder 7. A pressure medium is compressed thereby and the pressure thereof is transmitted through the pressure-medium line 15. In the embodiment of the invention shown in FIG. 2, the positioning unit 1 is mounted on a side wall 2 by a flange 20. The paper-guiding cylinder 5 is mounted in a bearing bushing 23 through the intermediaries of a journal 22 and a bearing 21.

FIGS. 3*a* and 3*b* illustrate in side elevational and top plan views, respectively, a remotely controlled mechanism for clamping devices for a compressed-air connection or union. In a manner similar to that shown in FIG. 1*a* and 1*b*, the paper-guiding cylinders 4, 5 and 6, respectively, have a positioning cylinder 7. A positioning unit 1 is connected through the intermediary of a threaded connection with a flexible compressed-air supply line 33 to a lever mechanism 25, which is formed with a bore 25.1 and has a separate compressed-air union or connection.

Closures 26 and 27 as well as an annular cap 34 in front of the positioning cylinder 7, are disposed on the end face of the paper-guiding cylinder 4. On the paper-guiding cylinder 5, the closures are identified by reference numerals 28 and 29. On the paper-guiding cylinder 6, closures 30 and 31 are provided. Sealing rings 32 are recessed in the lever mechanism 25 at the regions wherein the closures 26 to 31 and the annular caps 34 engage with the lever mechanism 25. In the position illustrated in FIG. 3*b*, for example, the clamping device on the paper-guiding cylinder 5 is actuated; the closure 26 and 31 close the outlet openings of the lever mechanism 25; the compressed air supplied to the lever mechanism 25 acts only, through the annular cap 34, on the positioning cylinder 7 of the paper-guiding cylinder 5, Wherein a piston, acting against the bias of a compression Spring, is energized with compressed air and, due to its displacement, compresses a pressure medium. The annular caps 34 are located at the end faces of all of the paper-guiding Cylinders in order to permit actuation of the built-in positioning cylinders 7.

After the clamping device on the paper-guiding cylinder 5 has been actuated, the compressed air is turned off, the lever mechanism 25 is returned and the positions of the paper-guiding cylinders 4, 5 and 6 are changed so that, for example, the clamping device on the paper-guiding cylinder 4 can be actuated. For this purpose, the closures 29 and 30 close the corresponding outlet openings formed in the lever mechanism 25 and, through the annular cap 34, the compressed air is able to trigger the actuation of the clamping device on the paper-guiding cylinder 4 through the intermediary of the positioning cylinder 7. The procedure is analogous for actuating the clamping device on the paper-guiding cylinder 6.

FIGS. 4*a* and 4*b* are cross-sectional views in detail of a clamping bar during the clamping operation wherein it is triggered by a flexible or expansible hollow body or seal 35, the views illustrating two operating phases thereof. The pressure-transmitting pressure--medium line 15 is connected to the flexible or expansible hollow body 35, which is received in the paper-guiding cylinder 6. Instead of an elongated flexible or expansible hollow body 35, a plurality of small cylinders may be installed which are connected to a common pressure-medium line 15. When the expansible hollow body 35 has been pressurized, it deflects a clamping bar 41 about a rotational axis A against a spring force exerted by compression springs 36. When the pressure on the flexible hollow body 35 is relieved initially, the compression springs 36 turn the clamping bar 41 about the rotational axis A until a cylinder covering 37 is gripped at a gripper-support bar 38. The cylinder covering 37 is drawn around a front edge 39 of the cylinder 6. Then, the cylinder covering 37 can be initially subjected to tensioning by a tensioning device at a non-illustrated rear edge of the paper-guiding cylinder. When the pressure on the flexible hollow body 35 is further relieved, the clamping bar 41 turns about a rotational axis B until the cylinder covering 37 is pressed against the gripper-support bar 38 by a front face of the clamping bar 41 due to the force applied by the compression springs 36 (note FIG. 4*b*). A bend or kink E is thereby formed in the cylinder covering 37. FIG. 4*a'* shows the end of the cylinder covering 37 to be clamped as having a length CD. When finally clamped, as shown in FIG. 4*b'* the cylinder covering 37 is stretched in length a difference (CE+ED)-CD and is thereby tightened in flat engagement with and around the front edge 39 of the cylinder 6, about the larger radius II shown in FIG. 4*a*. The cylinder covering 37 thereby rests fully on the outer cylindrical surface 45 of the corresponding paper-guiding cylinder 6.

FIGS. 5*a*, 5*b* and 5*c* show different embodiments of built-in deformable hollow bodies subjected to pressure medium. In FIG. 5*a*, a clamping bar 44 is disposed between the hollow body 35 and compression springs 36, and a cylinder covering can be clamped by relieving pressure applied to the hollow body 35.

FIG. 5*b* shows an embodiment wherein the flexible and expansible hollow body 35 is encased in a clamping bar 43 and, when subjected to pressure acting against the compression springs 36, is braced against the gripper-support bar 38. FIG. 5*c* shows yet another embodiment with a clamping bar 42.

FIGS. 6*a* and 6*b* are views of different embodiments of cylinders actuated by pressure medium for installation in a gripper support bar. In these embodiments, pressure-medium lines and pressure bodies are provided in the gripper-support bar 38.

In FIG. 6*a*, the pressure body 49 is subjected to pressure via the pressure medium line 15 communicating therewith at the end face thereof. Through the intermediary of a piston 47 having an O-ring 50 and operative against the force of a compression spring 48, a clamping bar 46 may be moved in a manner that no force acts upon the gripper-support bar 38. Pretensioning of the clamping bar 46 can be effected both through the intermediary of an adjusting nut 51 as well as through a suitable choice of compression springs. A compression spring 58 causes an opening of the clamping gap and thus facilitates the introduction of the leading or front edge of the cylinder covering.

In FIG. 6*b*, a pressure body 55, which is connected to the pressure source, is screwed into a gripper support bar 38. The pressure body 55 houses a piston 53 with an 0-ring 56. Additionally screwed into the pressure body 55 is a guide body 52, which is connected to the pressure-medium line 15. The guide body 52 is formed with bores and is sealed by an O-ring 57 against the piston 53 which is displaceable on the guide body 52. When the chamber between the pressure body 55 and the piston 53 is subjected to the application of pressure medium, the piston 53 slides the clamping bar 46 against the force of the compression spring 54 and permits the introduction of a cylinder covering between the clamping bar 46 and the gripper support bar 38.

FIGS. 7, 7*a*, 7*b* and 7*c* depict the application of pressure by an operator-control element of a combined tensioning and clamping device to the rear edge of a paper-guiding cylinder 5. In FIGS. 7*a*, 7*b* and 7*c*, the pressure medium is identified by stipplying.

A tensioning lever 65 is turnably held in a counterbearing 67 at the rear edge of the paper-guiding cylinder 5. The tensioning lever 65 is pre-tensioned by a tensioning spring 62. A flexible or expansible hollow body 35 is held by an angle support 66. Mounted on the tensioning lever 65 is a clamping bar 64 wherein another flexible or expansible hollow body 35 is held. The clamping bar 64 clamps a cylinder covering 37 against the tensioning lever 65 by means of a clamping spring 63 when the pressure on the flexible or expansible hollow body 35 is relieved. From the position of an operator-control element 59, shown in FIG. 7*a*, it is evident that the combined tensioning/clamping device is not subjected to pressure medium because no pressure medium is provided in the pressure lines 60 and 61. Tensioning force and clamping force are supplied through the intermediary of springs 62 and 63. If the operator-control element 59 is moved in the direction represented by the arrow F, as shown in FIG. 7*b*, pressure medium flows through the channels provided in the operator-control element 59 into the pressure line 61, which is connected to the flexible or expansible hollow body 35 in the angle support 66 (note FIG. 7). The tensioning lever 65 is swivelled against the spring 62 by the expansion or elongation of the hollow body 35. This results in the release of the cylinder covering 37, which is clamped at the leading and trailing edges thereof. FIG. 7*c* shows the position of the operator-control element 59 when the pressure line 60 is likewise filled with pressure medium in order to release the clamping of the cylinder covering 37 between the clamping bar 64 and tensioning lever 65. The pressure medium fed through the pressure-medium line 60 to the flexible or expansible hollow body 35 in the clamping bar 64 displaces the latter against the force of a clamping spring 63 and thus releases the clamping of the cylinder covering 37. As is apparent from FIG. 7*c*, the pressure lines 60 and 61, as well as the pressure chambers associated therewith are protected against excessive system pressure by spring-loaded check valves 68.

After a cylinder covering 37 has been clamped at the front or leading edge of the paper-guiding cylinders 4, 5 and 6, a subsequent, remotely controllable clamping and tensioning of the cylinder covering 37 at the rear or trailing edge of the paper-guiding cylinders 4, 5 and 6 are possible. The paper-guiding cylinders 4, 5 and 6 to be actuated can be moved to their respective positions, as mentioned hereinbefore, by selecting the printing unit and the cylinder from the remote-control desk The foregoing is a description corresponding in substance to German Application P 41 12 666.1, dated Apr. 18, 1991, the International priority of which is being claimed for the instant application, and which is hereby made part of this application. Any material discrepancies between the foregoing specification and the aforementioned corresponding German application are to be resolved in favor of the latter.

I claim:

1. In combination, at least one paper-guiding cylinder in a rotary printing press a clamping device on the at least one paper-guiding cylinder, and a device for actuating the clamping device, comprising a stationary positioning unit having means for receiving a pressure medium therein, a lever mechanism cooperatively engageable with said positioning unit, means for remotely controlling the clamping device through the intermediary of said lever mechanism, the clamping device having a clamping bar and pneumatic means for actuating said clamping bar into a clamping mode and into a non-clamping mode, said actuating means comprising a pneumatically effective positioning cylinder cooperatively engageable with said positioning unit, and spring means for maintaining said clamping bar in said clamping mode wherein a cylinder covering is clamped thereby on the respective cylinder.

2. The combination according to claim 1, including an expansible hollow body, and a pressure-medium line connecting said expansible hollow body to said positioning cylinder.

3. The combination according to claim 2, wherein said expansible hollow body extends over substantially the entire length of the cylinder.

4. The combination according to claim 2, wherein the paper-guiding cylinder has an outer cylindrical surface having a longitudinal gap formed therein at least partly defined by a leading edge, and wherein said clamping-bar actuating means include means for relieving pressure in said hollow body from the pressure medium in said pressure-medium line, whereby said clamping bar is actuated to move the cylinder covering in a radial direction and around the leading edge and onto the outer cylindrical surface.

5. The combination according to claim 2, wherein said clamping bar actuating means include means for initially and subsequently relieving pressure in said hollow body so that initially, said clamping bar having a first and a second turning axis and being turnable by said spring means about said first turning axis and, subsequently, is swivellable by said spring means about said second turning axis.

6. The combination according to claim 1, including an expansible hollow body disposed in the paper-guiding cylinder adjacent said clamping bar for moving said clamping bar against said spring means.

* * * * *